US007503551B2

(12) United States Patent
Auret

(10) Patent No.: US 7,503,551 B2
(45) Date of Patent: Mar. 17, 2009

(54) FENCE CONSTRUCTION SYSTEMS

(75) Inventor: Derek Michael Auret, Queensland (AU)

(73) Assignee: Crimp Tech Industries, Carson City, NV (US)

( * ) Notice: Subject to any disclaimer, the term of this patent is extended or adjusted under 35 U.S.C. 154(b) by 0 days.

(21) Appl. No.: 10/549,772

(22) PCT Filed: Dec. 20, 2004

(86) PCT No.: PCT/AU2004/001791

§ 371 (c)(1),
(2), (4) Date: Sep. 19, 2005

(87) PCT Pub. No.: WO2005/059279

PCT Pub. Date: Jun. 30, 2005

(65) Prior Publication Data

US 2006/0226407 A1 Oct. 12, 2006

(30) Foreign Application Priority Data

Dec. 18, 2003 (AU) ..... 2003906987
Jul. 19, 2004 (AU) ..... 2004903930
Nov. 30, 2004 (AU) ..... 2004906824

(51) Int. Cl.
*E04H 17/14* (2006.01)

(52) U.S. Cl. ..... 256/65.12; 256/22

(58) Field of Classification Search ..... 256/19, 256/21, 22, 24, 59, 65.01, 65.02, 65.09, 65.11, 256/65.12; 29/512, 523
See application file for complete search history.

(56) References Cited

U.S. PATENT DOCUMENTS 1,070,814 A * 8/1913 Kimball ..... 5/283
1,114,486 A * 10/1914 Kimball ..... 5/283
1,234,674 A * 7/1917 Lachman ..... 256/22
1,236,185 A * 8/1917 Lachman ..... 256/22
1,791,680 A * 2/1931 Miller ..... 52/690
2,590,929 A * 4/1952 Bush ..... 256/22
2,614,827 A * 10/1952 Peach et al. ..... 285/192
3,244,406 A * 4/1966 Garofola ..... 256/21
3,357,681 A * 12/1967 Souza, Jr. ..... 256/65.02
3,522,933 A * 8/1970 Braun ..... 256/22
3,822,053 A * 7/1974 Daily ..... 256/22
4,146,212 A * 3/1979 Lermer ..... 256/68
4,451,025 A * 5/1984 Spera ..... 256/65.12
5,382,001 A * 1/1995 Lichti ..... 256/65.09
5,613,664 A 3/1997 Svalbe
6,088,902 A * 7/2000 Summers ..... 29/523

(Continued)

FOREIGN PATENT DOCUMENTS

AU 200031306 A1 11/2000

(Continued)

*Primary Examiner*—Daniel P Stodola
*Assistant Examiner*—Joshua T Kennedy
(74) *Attorney, Agent, or Firm*—Panitch Schwarze Belisario & Nadel LLP

(57) ABSTRACT

A fence construction system in which pickets (52) are attached to rails (50, 51) using fastening means located inside the rails. In one embodiment the pickets are fastened to a rail by a common locking rod. In another embodiment, the pickets (52) are deformed inside the rail (51) by a crimping tool. Equipment that facilitates assembling of the fence may be provided. Top or bottom rails may also have a support structure provided within the rail.

11 Claims, 18 Drawing Sheets

U.S. PATENT DOCUMENTS

| | | | | |
|---|---|---|---|---|
| 6,254,064 | B1 * | 7/2001 | Gibbs | 256/22 |
| 2002/0175321 | A1 | 11/2002 | Larsen et al. | |
| 2006/0214149 | A1 * | 9/2006 | Hung | 256/22 |
| 2007/0015390 | A1 * | 1/2007 | Brownbill | 439/179 |

FOREIGN PATENT DOCUMENTS

| | | |
|---|---|---|
| AU | 2003248210 B1 | 3/2004 |

* cited by examiner

FENCE CONSTRUCTION SYSTEMS

CROSS-REFERENCE TO RELATED APPLICATION

This application is a section 371 of International Application No. PCT/AU2004/001791, filed Dec. 20, 2004, which was published in the English language on Jun. 30, 2005, under International Publication No. WO 2005/059279 A1 and the disclosure of which is incorporated herein by reference.

BACKGROUND TO THE INVENTION

This invention relates to construction of fences, in particular but not only to systems for construction of pool fences or balustrades. The systems might also be suitable for other structures which in some cases have picket-like features in common with fences, such as ladders or walls.

Pool fences are constructed in a wide variety of ways. A standard pool fence typically has a number of aluminium panels that are formed separately and then placed in position together. Each panel has two or more horizontal rails that support a series of vertical pickets. The panels are assembled by passing the pickets through apertures in the rails. Each picket is then usually welded or crimped to the rails and the assembled structure is painted. The rails and pickets come in many forms and may be assembled in a wide variety of structures.

The existing methods of construction require each picket to be individually handled and fastened to the rails. Each panel typically has 20-30 pickets so the methods are generally slow with a significant cost of manual labour. The need to paint the panel after the pickets have been fastened to the rails can also be a disadvantage. Structural weaknesses are sometimes experienced in panels where the pickets do not extend beyond the top rail. In these systems the top ends of the pickets lie within the top rail and can be difficult to fasten sufficiently strongly to the rail.

SUMMARY OF THE INVENTION

It is an object of the invention to provide for improved construction of pool fences, or at least to provide an alternative to existing systems.

In one aspect the invention resides in a fence having at least one hollow rail and a plurality of pickets supported by the rail, wherein the pickets enter the rail by passage through respective entry apertures in the rail, and are fastened to the rail by fastening means located inside the rail.

In one embodiment, each picket includes a fastening aperture located within the rail and the fastening means includes a rod that passes through the fastening apertures and thereby prevents further passage of the pickets through their respective entry apertures. Preferably the fastening apertures are located adjacent an inner surface of the rail and the rod has been forced through the fastening apertures against resistance from the inside surface of the rail.

In another embodiment, the fastening means includes a portion of each picket located inside the rail that has been deformed after entry of the picket within the rail and thereby prevents further passage of the pickets through their respective entry apertures. Preferably the portion of each picket that has been deformed within the rail has a partly flattened shape that no longer matches the shape of the respective entry aperture in the rail.

In one part of the fence, the pickets pass through the rail from one side to the other. Preferably the fence has two parallel rails that support the pickets and the pickets pass fully through at least one of the rails.

In another part of the fence the pickets pass though only one side of the rail and end within the rail. Preferably the rail has an internal wall and the pickets end in respective apertures of the internal wall.

In a further aspect the invention resides in a fence having at least one hollow rail and a plurality of pickets supported by the rail, wherein the rail has an external wall with entry apertures for the pickets, and an internal structure for holding end portions of the pickets, and wherein each picket enters the rail through a respective entry aperture and has an end portion which is held by the internal structure.

Preferably the internal structure of the rail includes a wall with holding apertures for respective end portions of the pickets. Preferably the holding apertures are aligned with the entry apertures so that the pickets are perpendicular to the rail. Alternatively the holding apertures are offset from the entry apertures so that the pickets are not perpendicular to the rail.

In one embodiment the internal structure is moveable within the rail to vary the alignment of the holding apertures and the entry apertures. In another embodiment the internal structure includes a plurality of flanges which receive end portions of respective pickets.

Preferably the pickets are fastened to the rail by fastening means provided inside the rail. The fastening means may be a rod that connects the pickets within the rail. Alternatively the fastening means is a deformed portion of each picket within the rail.

In another aspect the invention resides in a method of forming a picket structure, including: providing a hollow rail to support a plurality of pickets, passing each picket at least partly through the rail, and fastening the pickets to the rail from within the rail.

In one embodiment, fastening the pickets includes threading a rod through apertures in the pickets inside the rail. Threading the rod includes deformation of the rail through interaction between the rod and an inside surface of the rail.

In another embodiment, fastening the pickets includes deforming the pickets inside the rail. Preferably deforming the pickets includes passage of a crimping device through the rail.

In another aspect the invention resides in a picket construction having a rail and a plurality of pickets supported by the rail, each picket being fastened to the rail by fastening means located within the rail.

The construction may be a fence or balustrade, or a similar structure having similar rail and picket features such as ladder.

In another aspect the invention resides in equipment for constructing panels for a fence or picket structure as outlined above.

In another aspect the invention may be said to reside in a panel having two parallel posts, two parallel rails and a plurality of pickets supported by the rails, wherein the rails are fastened to the posts by pins through apertures in the ends of the rails.

The invention may also be said to reside in any alternative combination of features that are indicated in this specification. All equivalents of these features are deemed to be included.

LIST OF FIGURES

Preferred embodiments of the invention will be described with respect to the accompanying drawings, of which:

Figure 4A:
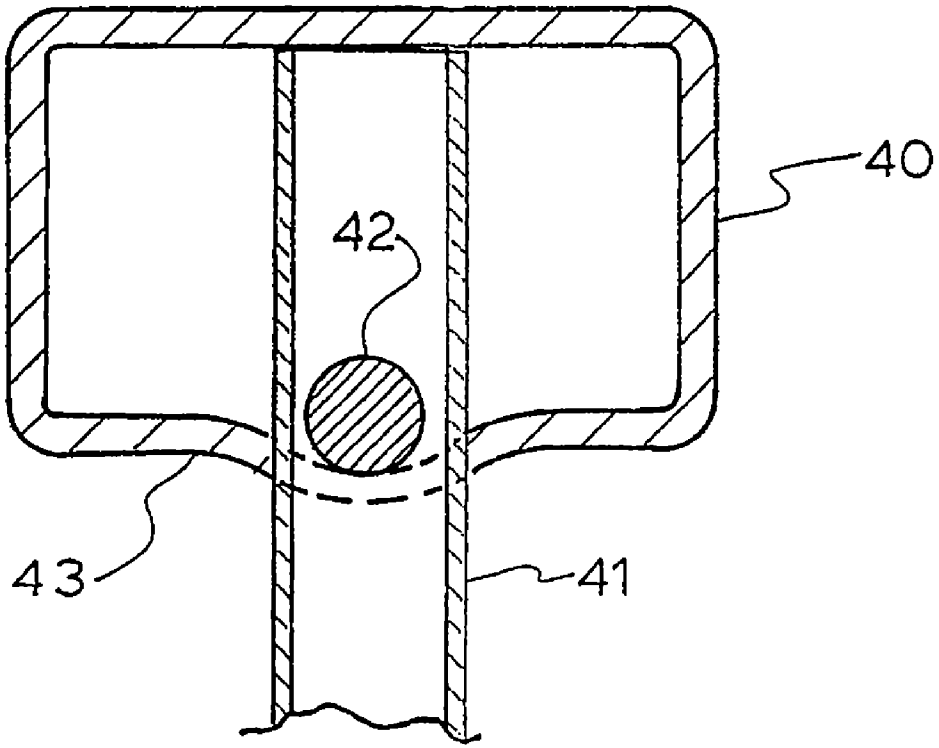
Figure 4B:
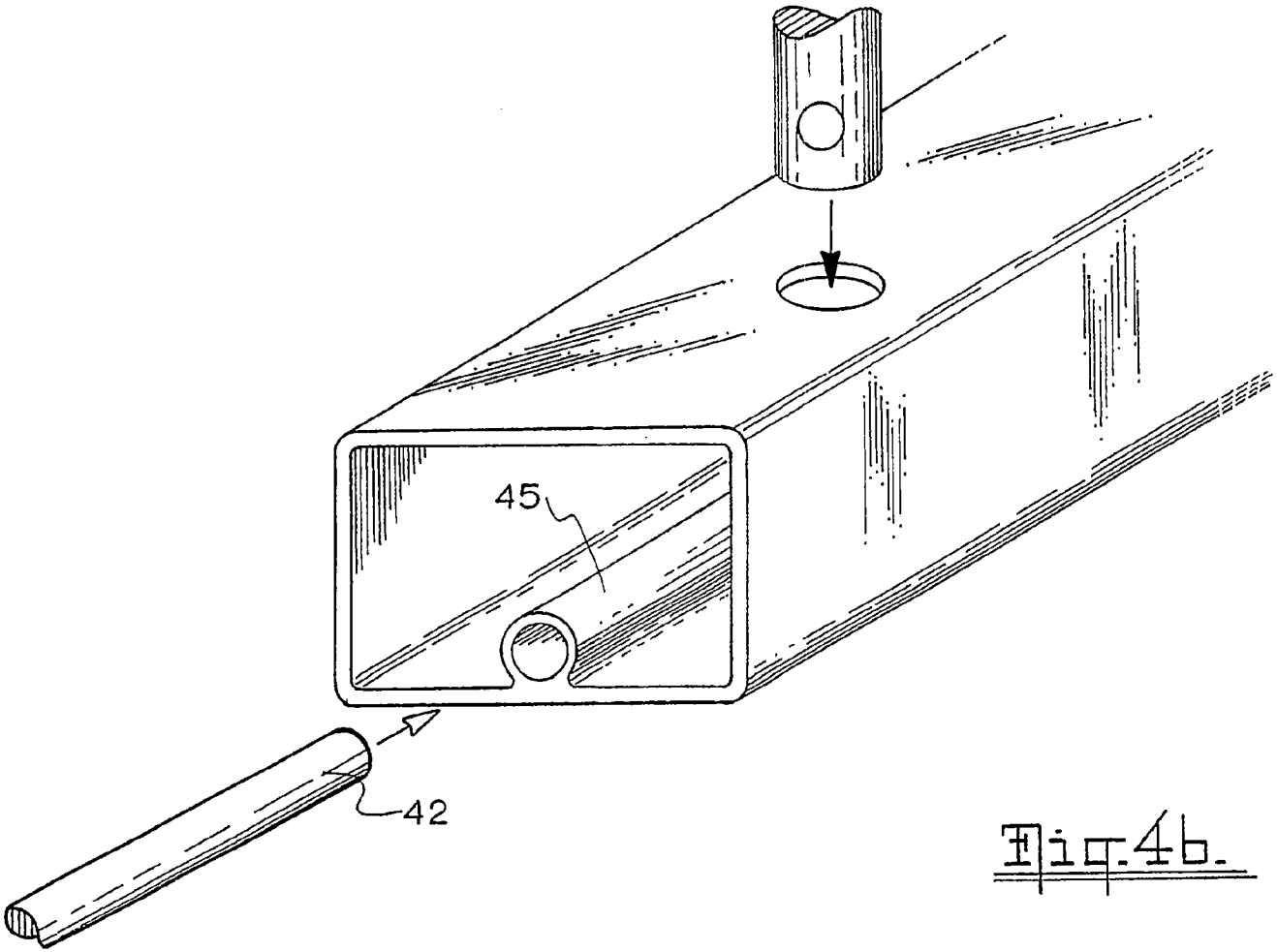
Figures 5, 5C, 6A, 6B, 6D:
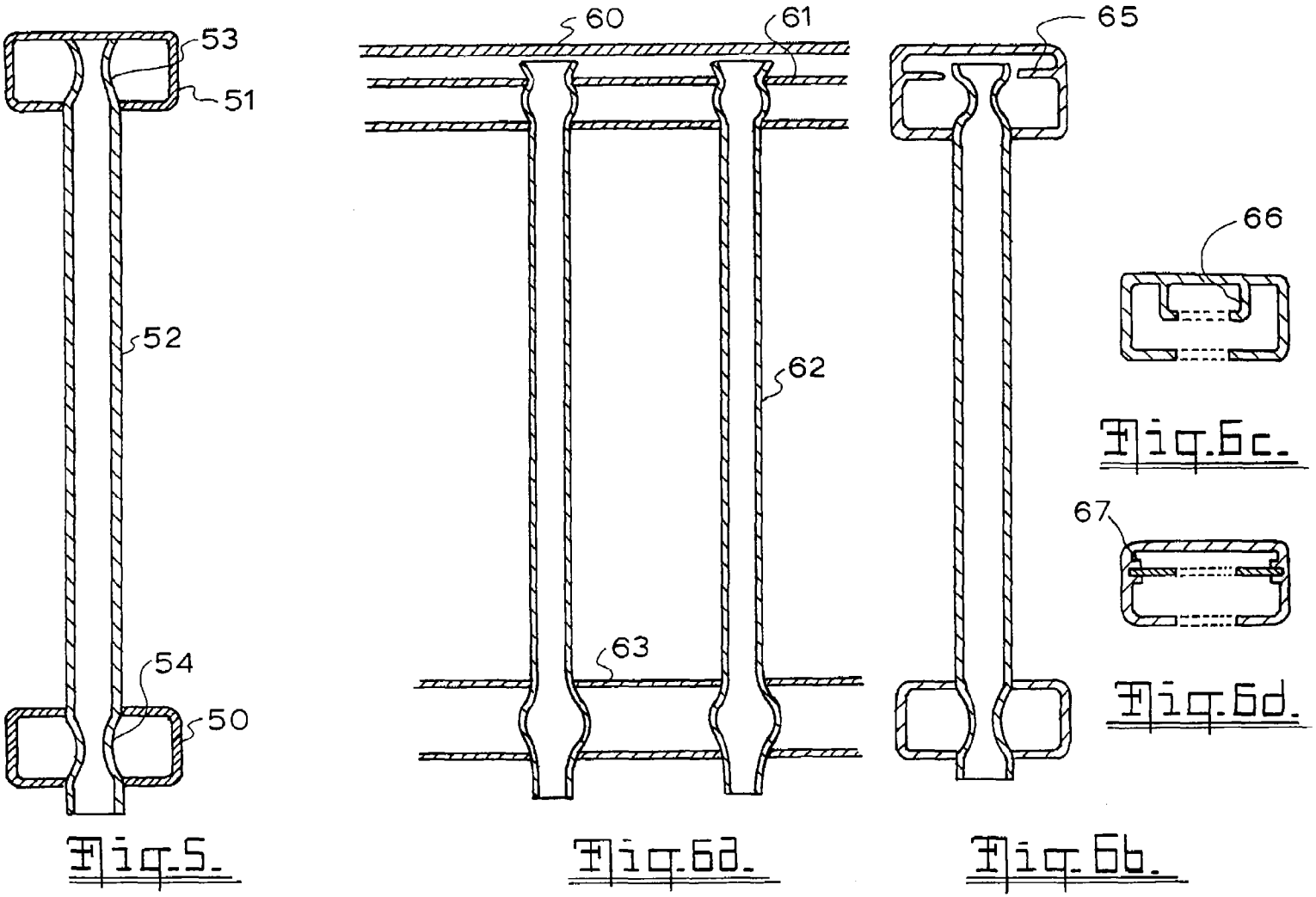
Figures 8A, 8B:
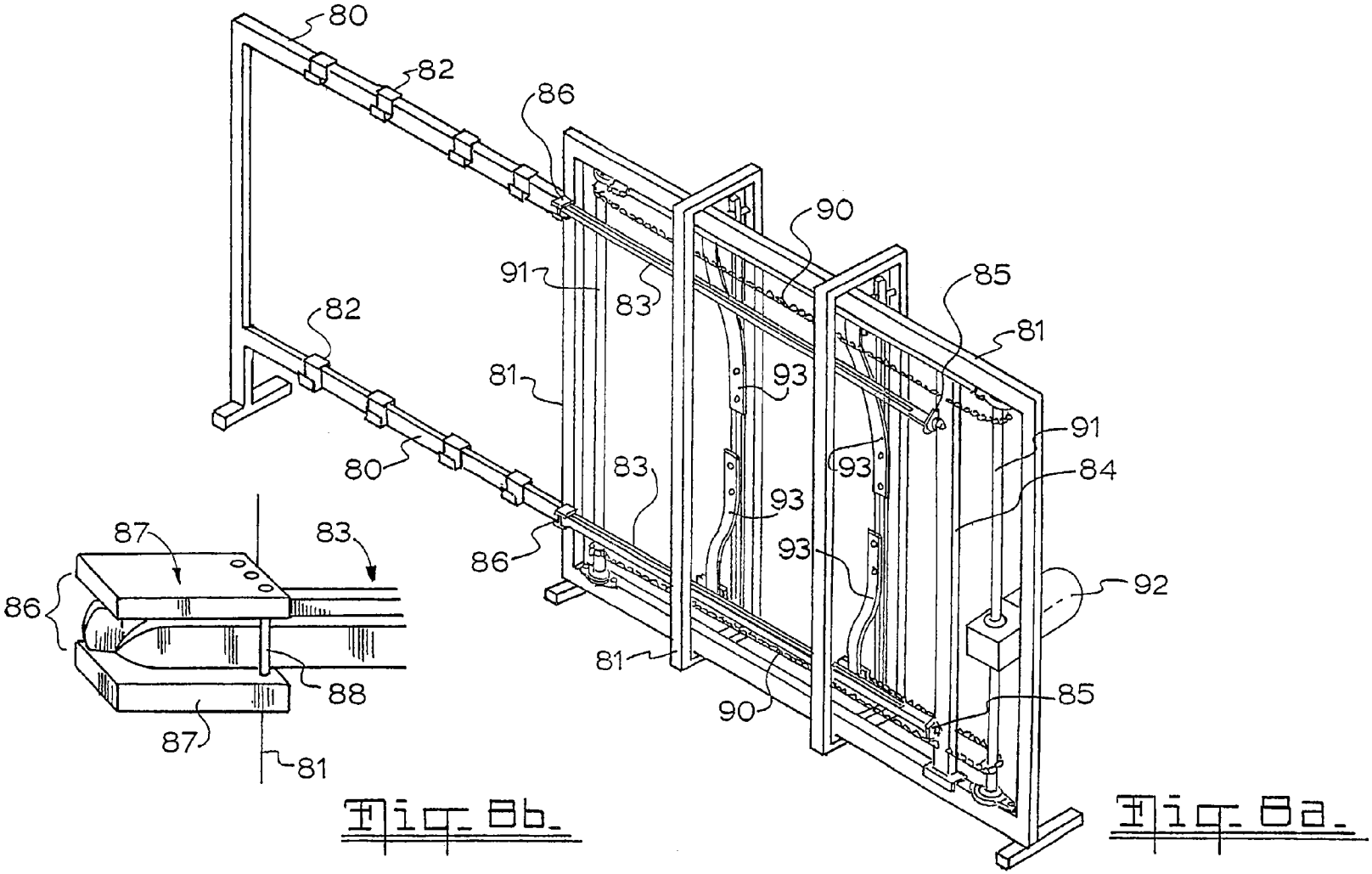
Figure 8C:
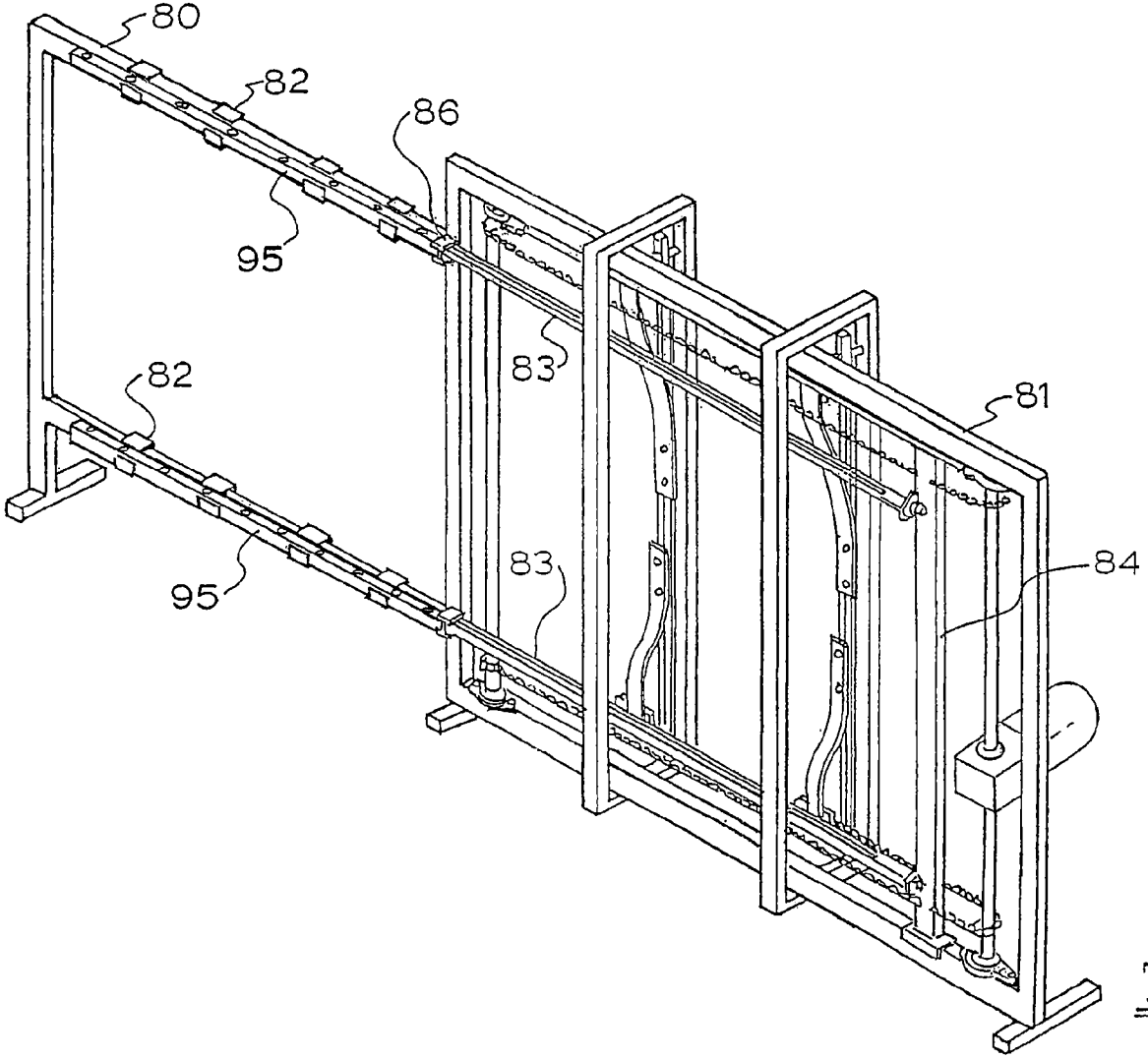
Figure 8D:
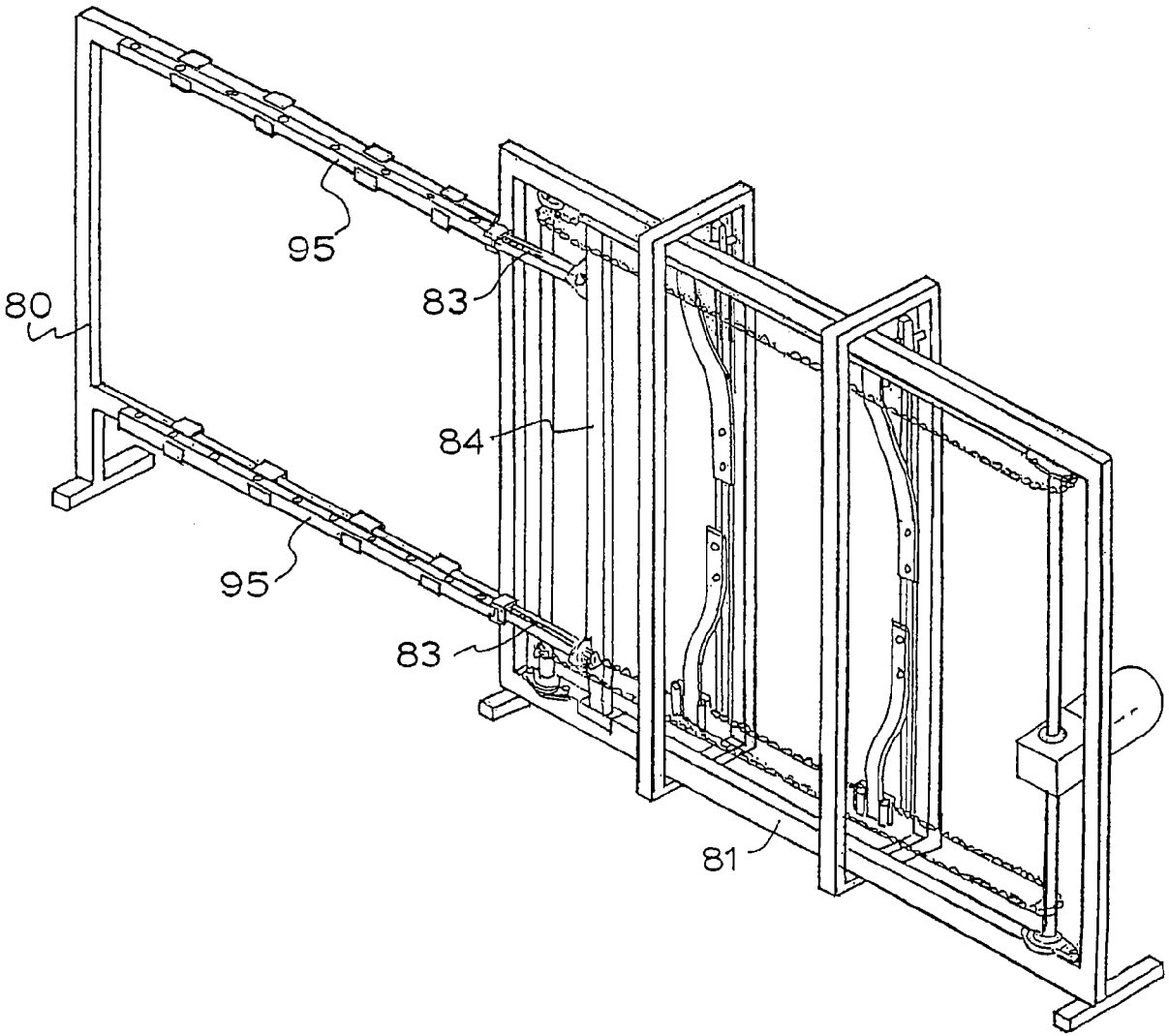
Figure 8E:
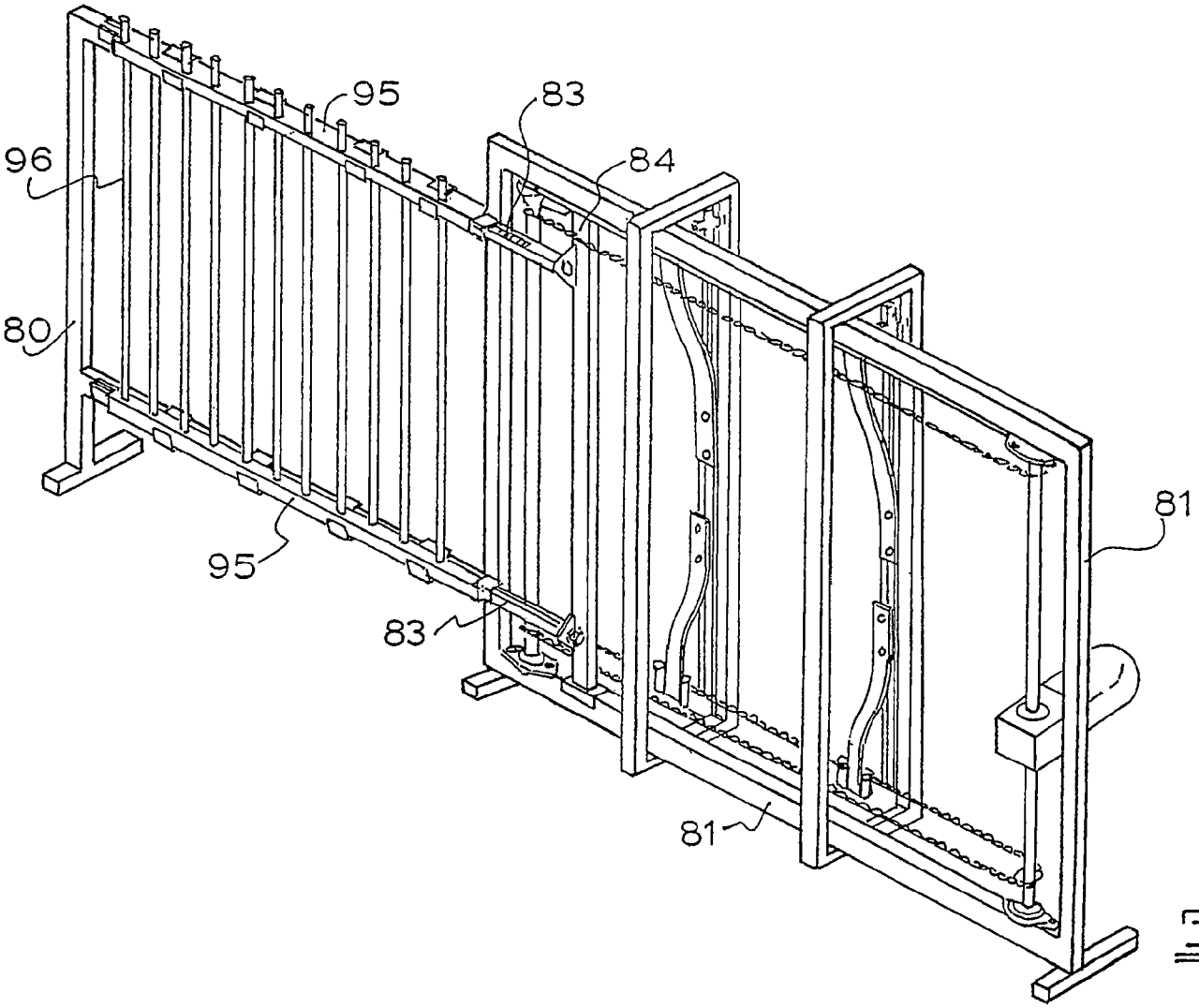
Figure 8F:
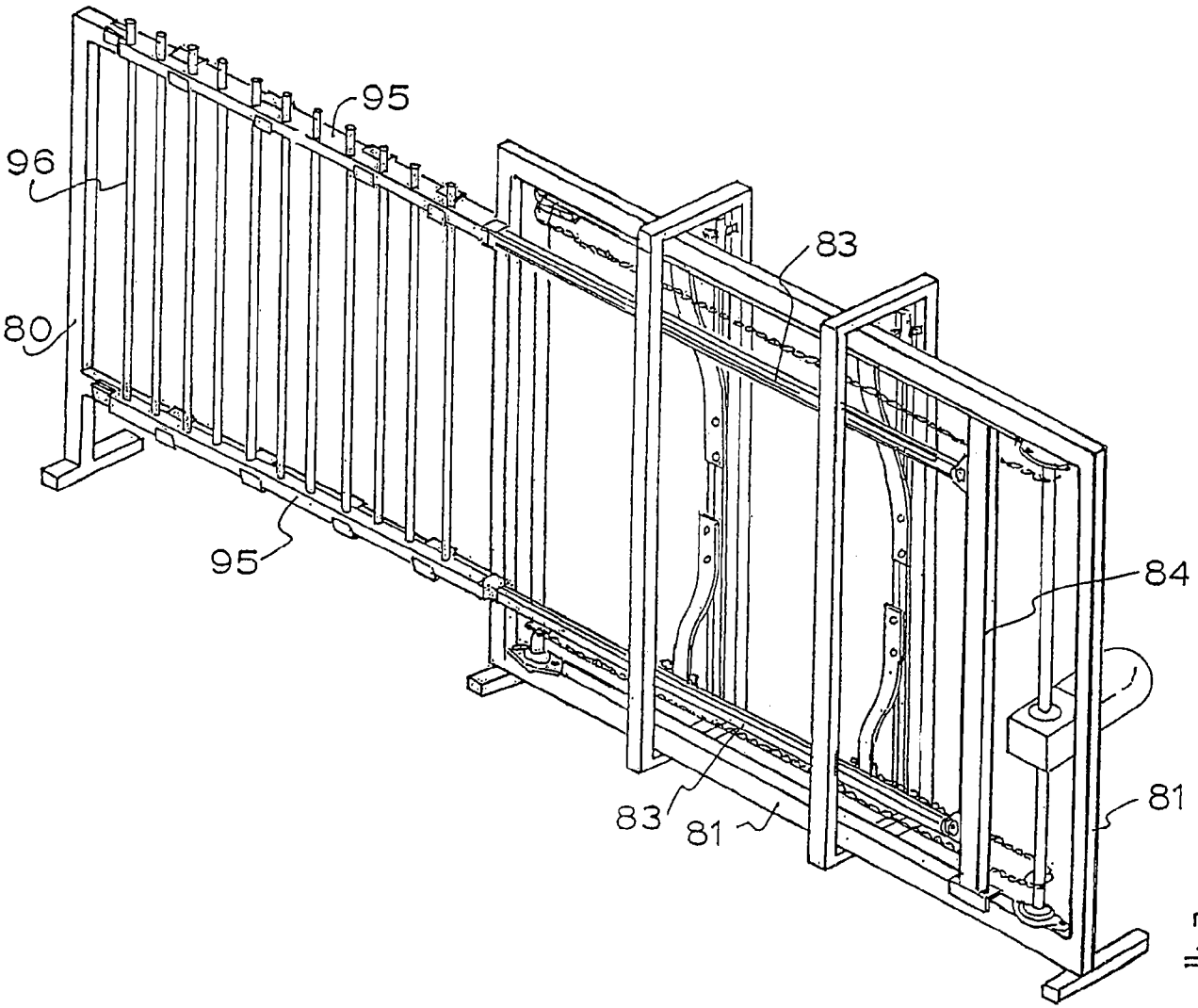
Figure 8G:
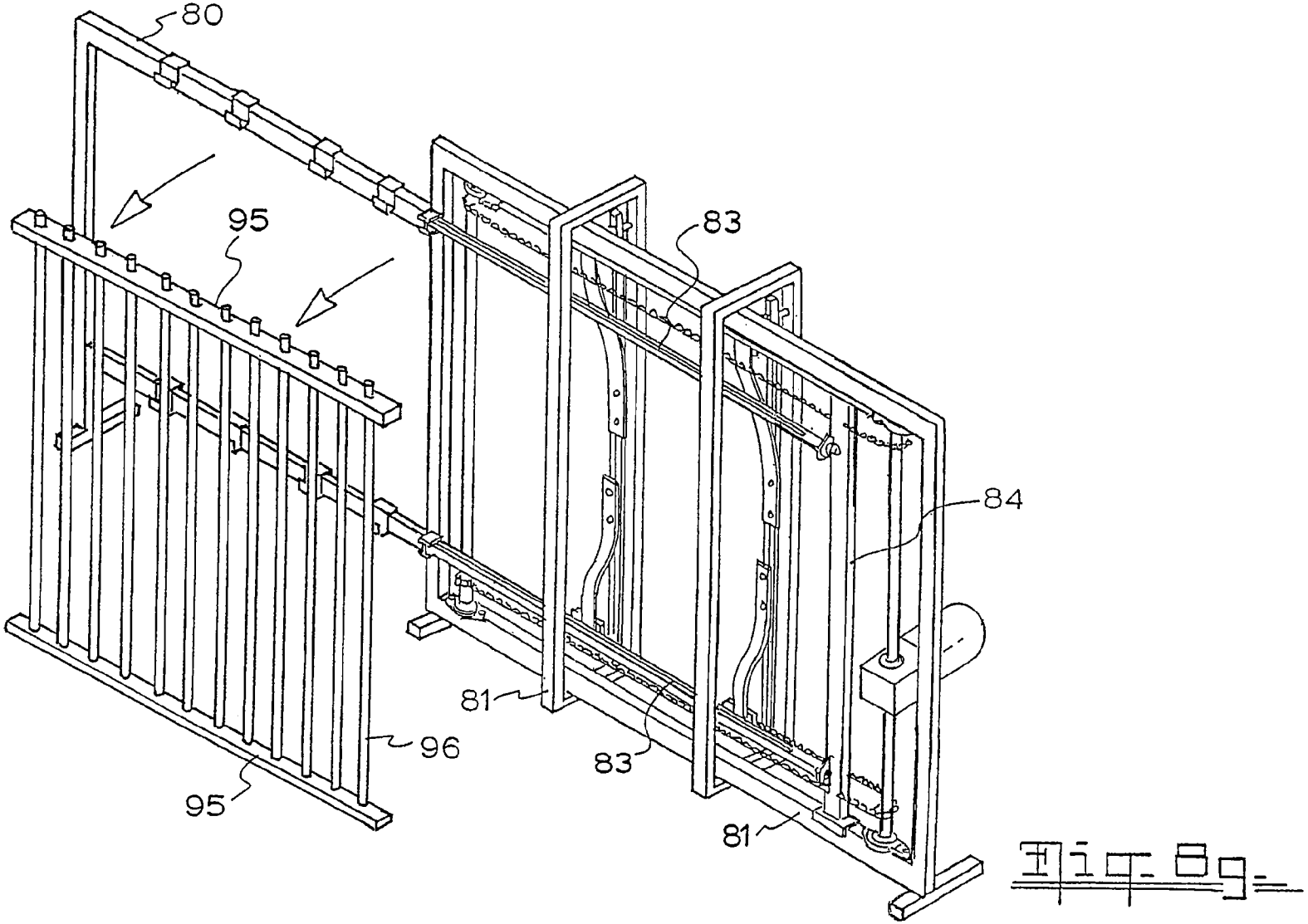
Figure 9B:
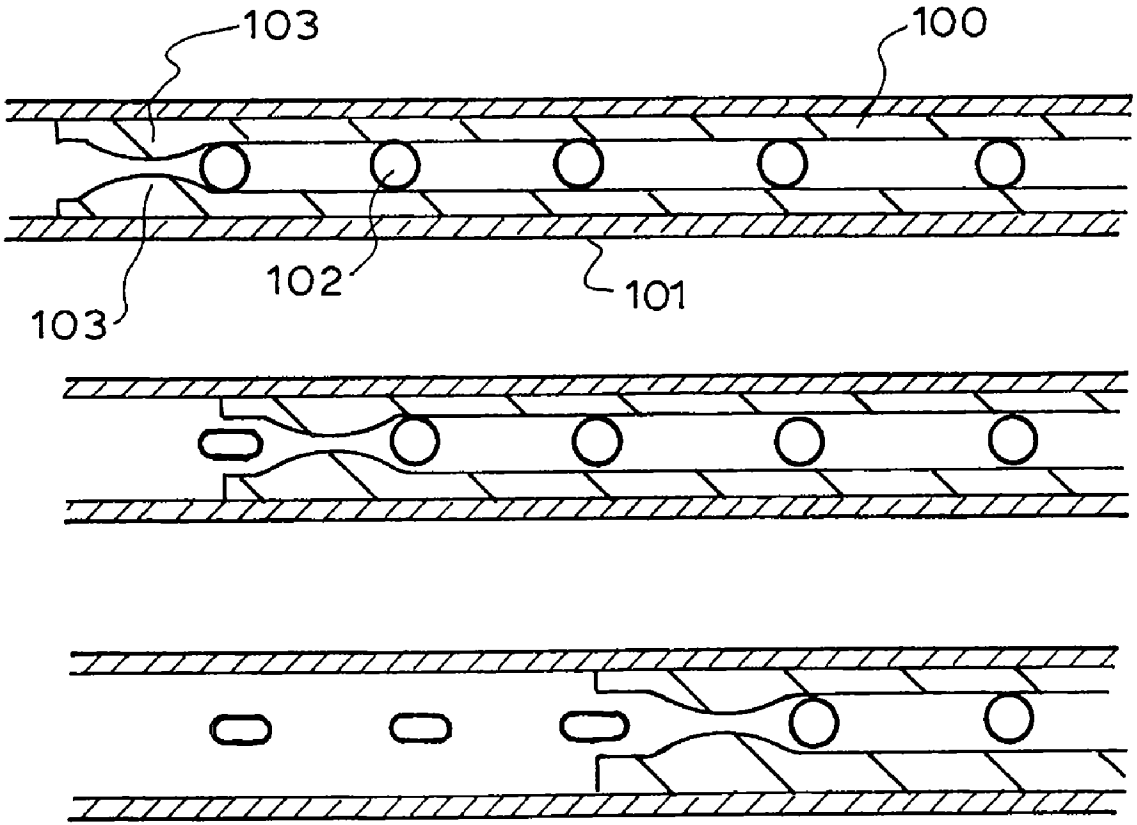
Figure 9B:
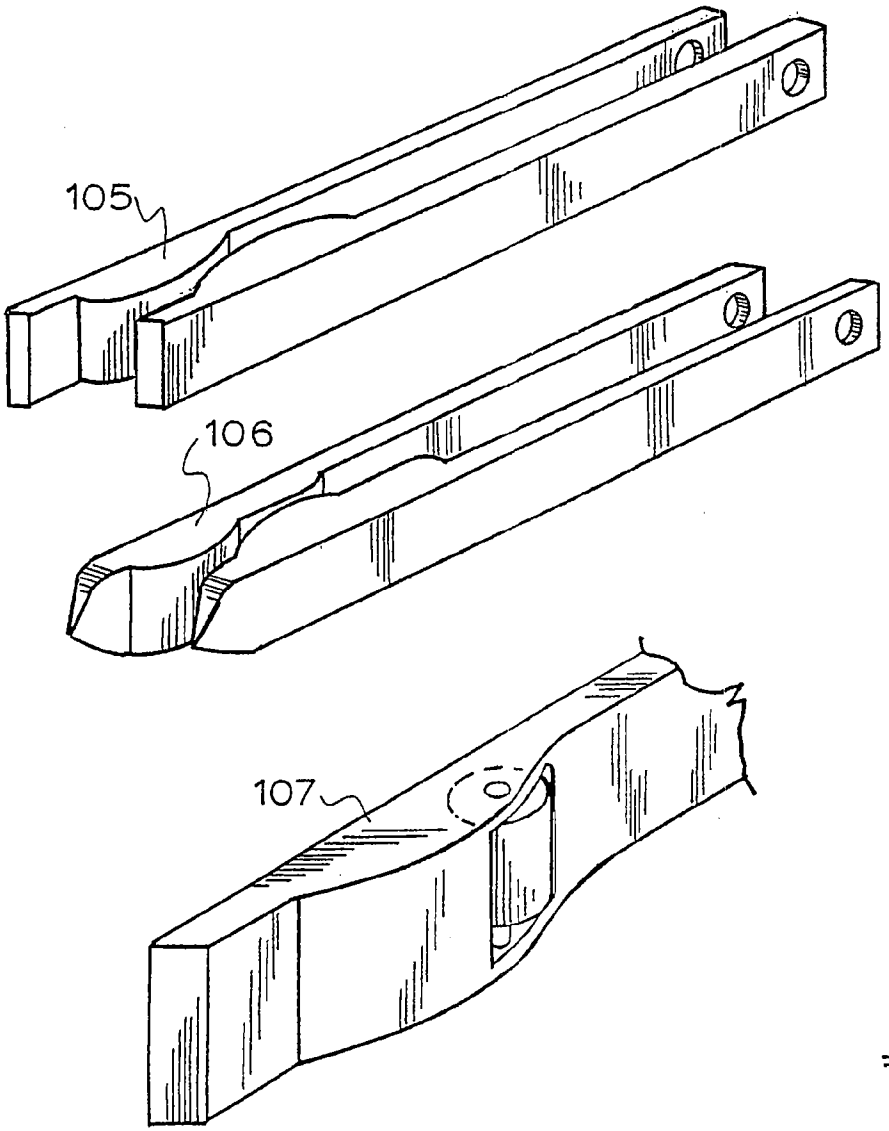
Figure 10A:
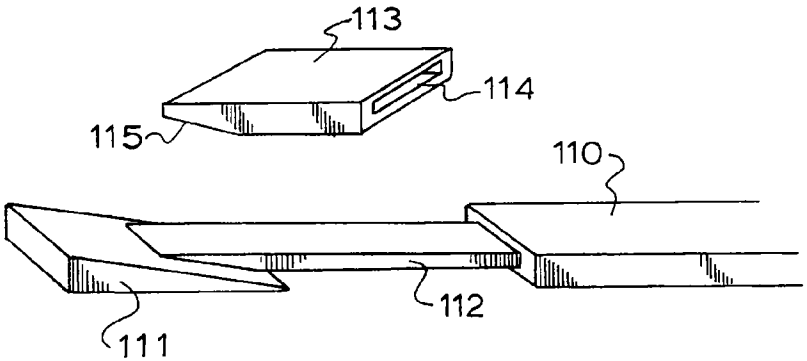
Figure 10B:
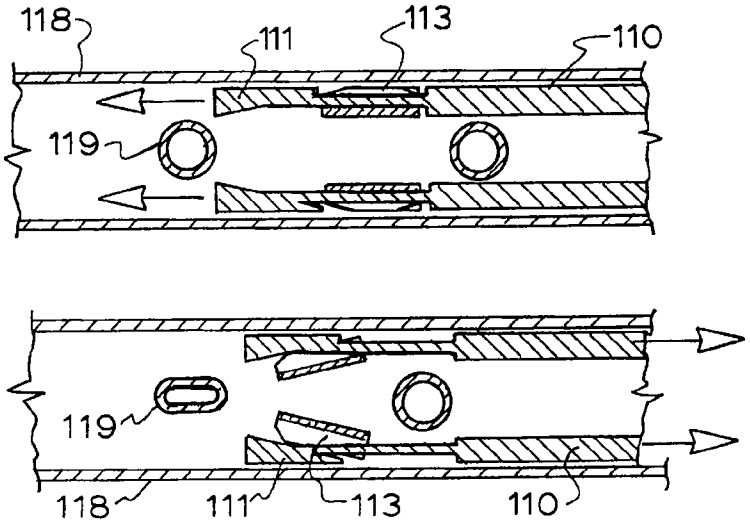
Figure 11:
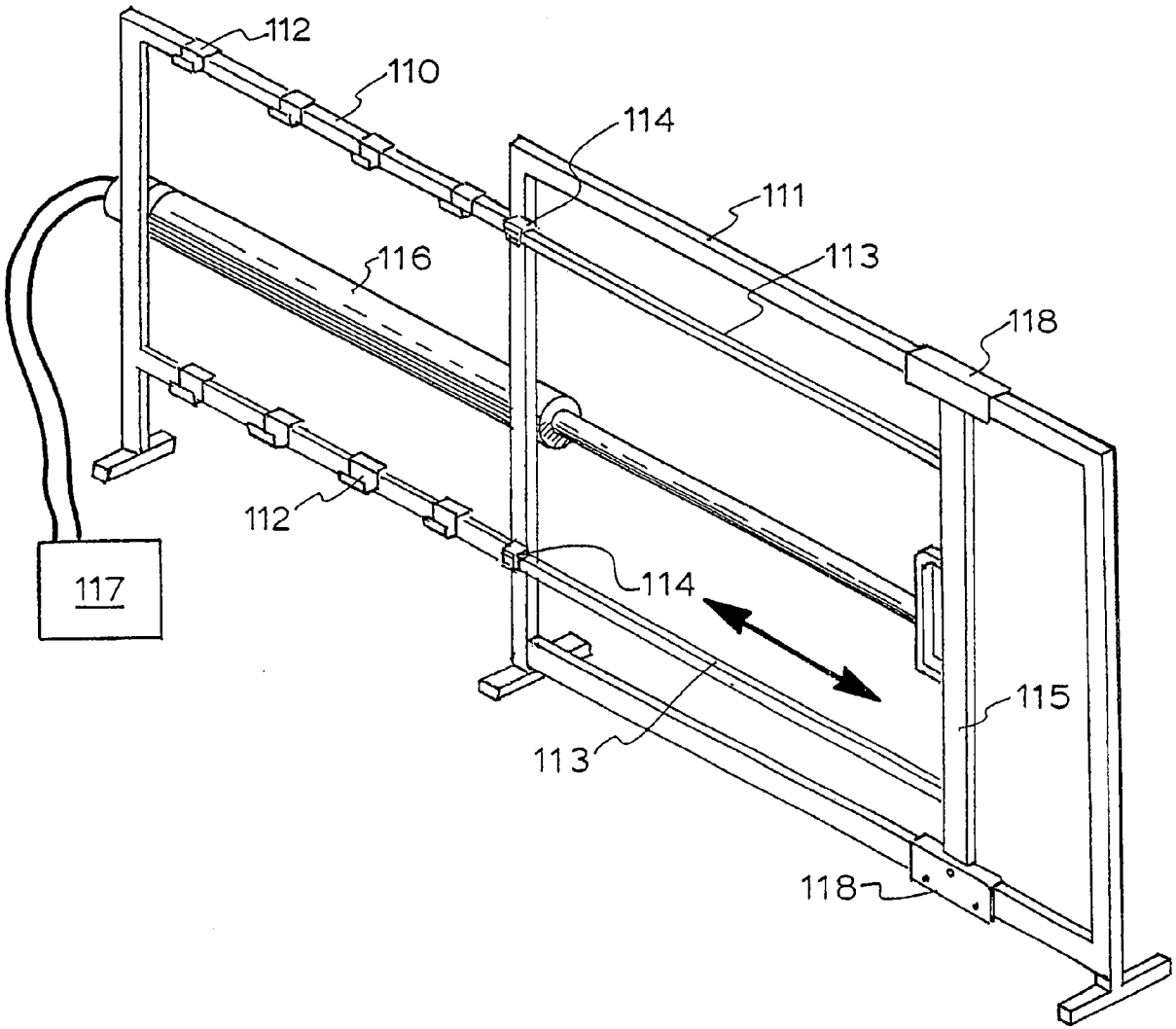

FIG. 4 shows one way of fixing the pickets within the rails using a locking rod, FIG. 5 shows another way of fixing the pickets within the rails by crimping, FIG. 6 shows how a top rail structure may be strengthened, FIG. 7 shows how the structure in FIG. 6 may be used in a raked panel, FIG. 8 shows the structure and operation of equipment that may be used to fix the pickets in the rails, FIG. 9 shows various crimping components for the equipment in FIG. 8, FIG. 10 shows an alternative component for the equipment in FIG. 8, and FIG. 11 shows alternative equipment.

DETAILED DESCRIPTION OF PREFERRED EMBODIMENTS

Referring to the drawings it will be appreciated that the invention can be implemented in various ways for a range of different picket-like structures, such as pool fences, balustrades, ladders, walls and the like. This description of pool fence embodiments is given by way of example only.

Figure 1:
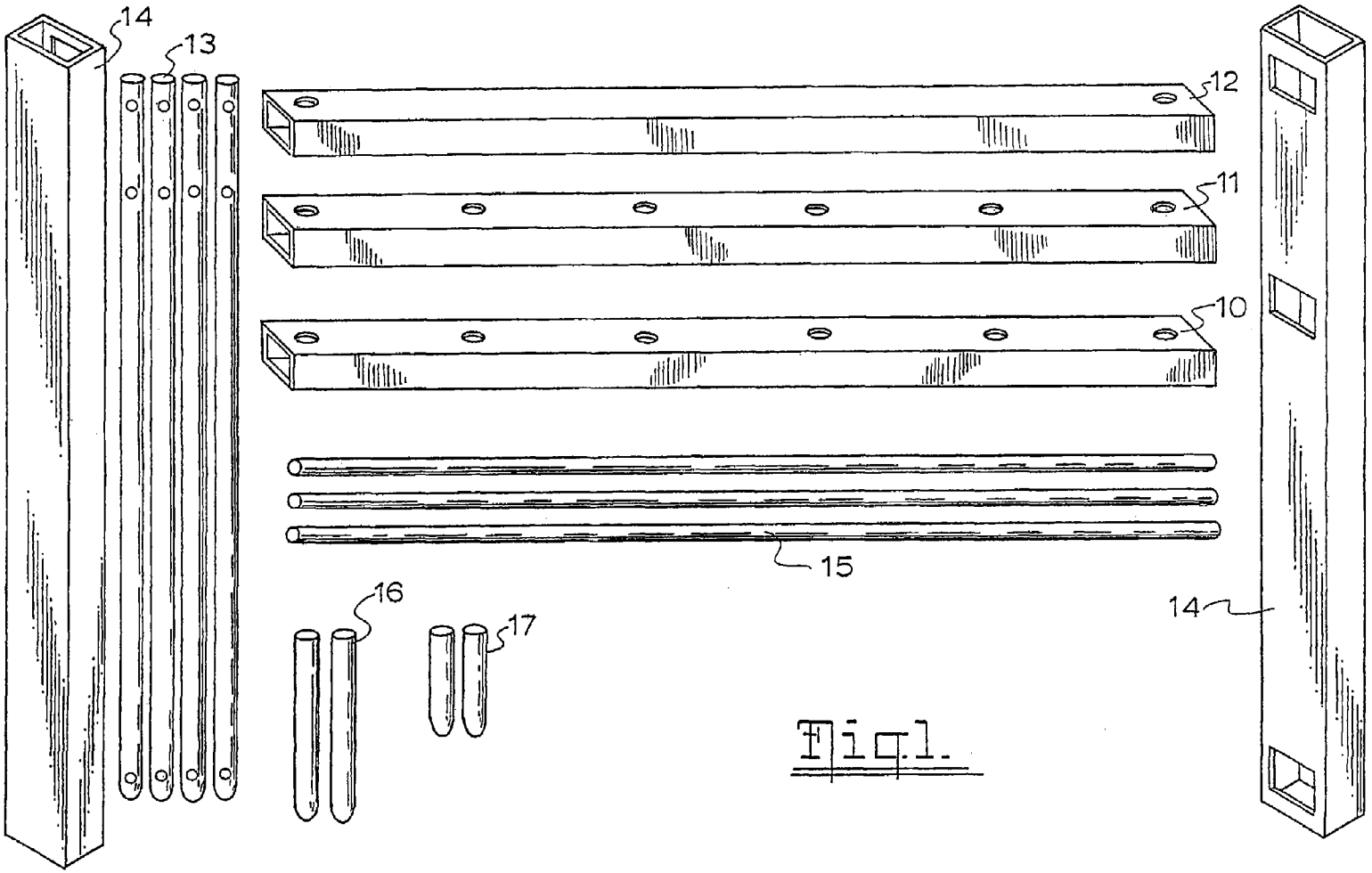
FIG. 1 shows components of a panel for a pool fence.

FIG. 1 shows the main components of a panel for a pool fence including a bottom rail 10, mid rail 11, a top rail 12, a number of pickets 13, two posts 14, locking rods 15 and top pins 16, and bottom pins 17. These components may be provided in a wide range of numbers, shapes, and sizes, and may be assembled in different ways, depending on the purpose and style of the fence. The components are usually provided has hollow tubes or other sections of a metal such as aluminium or steel.

Figure 2:
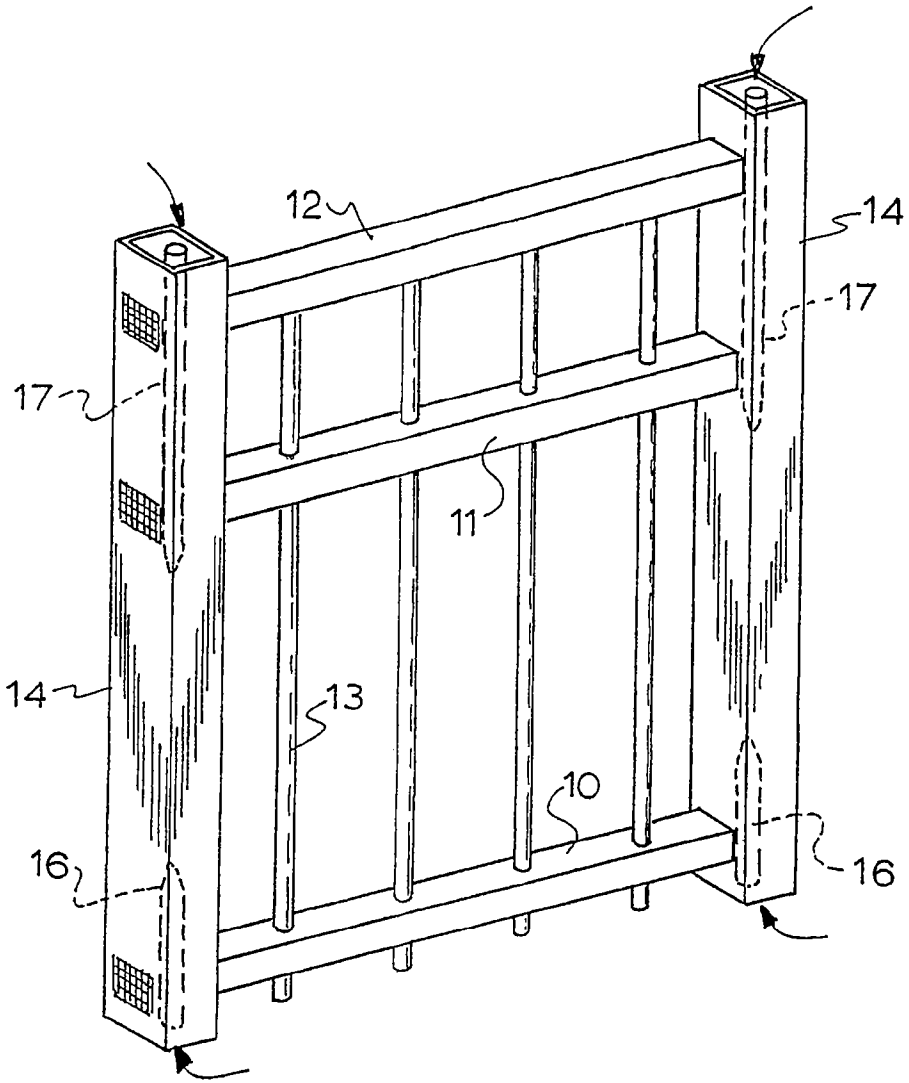
FIG. 2 shows an assembled panel having pickets held by three rails.

FIG. 2 shows how the panel may be assembled. The pickets 13 pass through pairs of apertures in the bottom and mid rails 10, 11 and in this example, enter but do not exit the top rail 12, which has apertures on one side only. The rails are fixed in apertures in the posts 14 using the bottom and top pins 16, 17. Traditionally the pickets are fastened to the rails by external welding or crimping. In this case the pickets are fastened by internal means, such as the locking rods 15 which thread the pickets, or by internal crimping.

Figure 3:
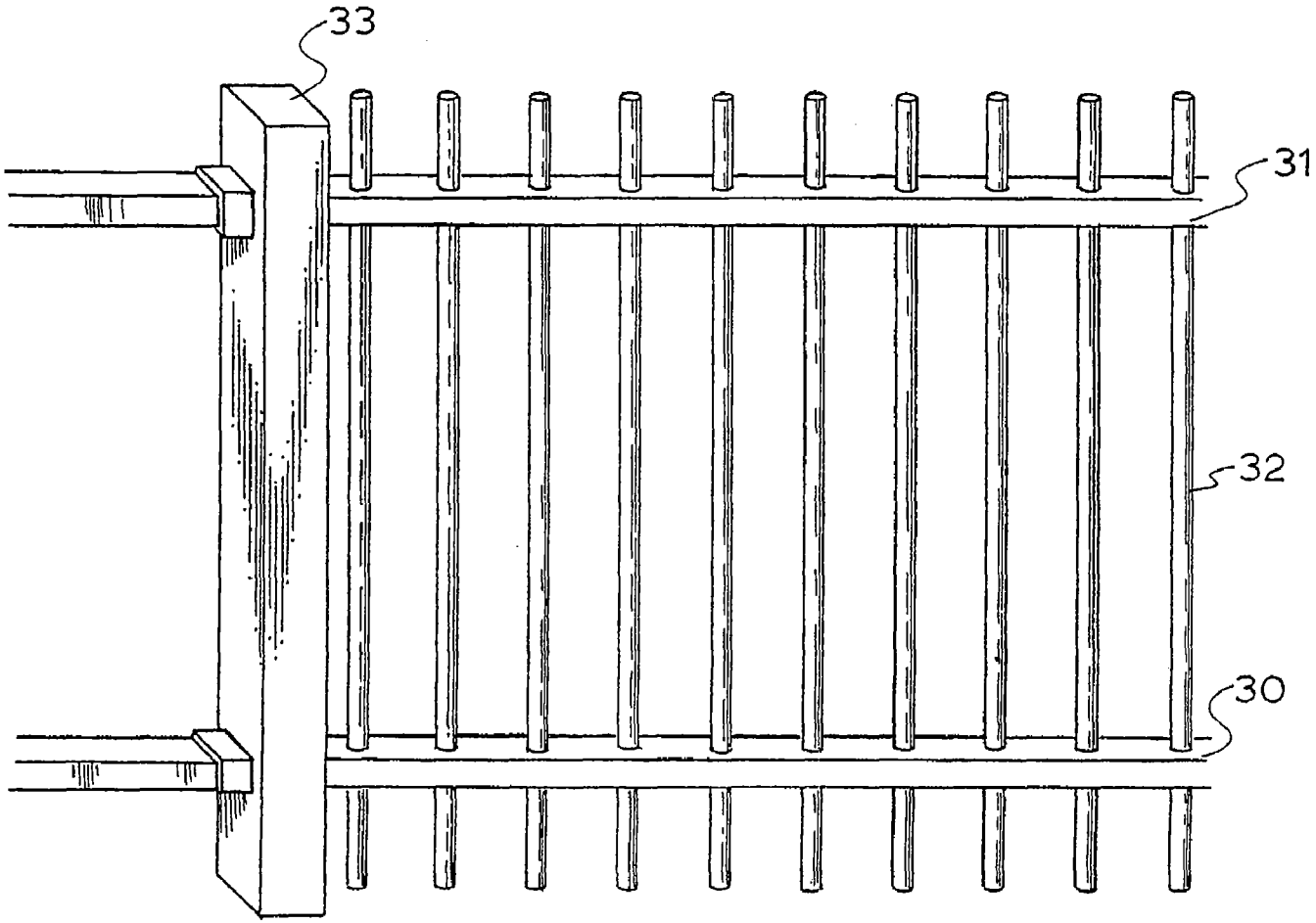
FIG. 3 shows an assembled panel having pickets held by two rails.

FIG. 3 shows part of a panel of another fence having bottom and mid rails 30, 31 only, and again by way of example. The pickets 32 pass through apertures in each rail and are fastened to the rails. Only a single post 33 is shown. It will be appreciated that the panels may be formed in a wide variety of styles, shapes and sizes, with large or small numbers of pickets.

FIGS. 4*a* and 4*b* show two ways of fastening a picket to a rail from within the rail, using a locking rod, such as rod 15 in FIG. 1. In FIG. 4*a*, a top rail 40 and one end of a picket 41 are shown in cross section. The picket passes through an aperture on the underside 43 of the rail. A locking rod 42 passes through an aperture in the picket, located inside the rail, and deforms the underside of the rail. The aperture in the picket partly overlaps with the aperture in the rail. Manual or machine generated force is required to insert the rod and causes the deformation. The rod threads all of the pickets in the panel.

FIG. 4*b* shows an alternative in which the inside of the rail includes a guide 45 for the locking rod 42. The guide may be continuous within the rail or interrupted by transverse apertures for the pickets, depending on the width of the guide. Apertures in the pickets are aligned with the guide as indicated. In both FIGS. 4*a* and 4*b* the pickets are shown as ending within a top rail, but may also pass through the rail as in a bottom or mid rail.

FIG. 5 shows another way of fastening a picket within a rail to form a panel or other structure. In this example, bottom rail 50 and top rail 51 hold the picket 52. The picket has been deformed in portions 53 and 54 within each rail, by crimping for example. A typically circular picket is deformed into a relatively flattened cross section within the rails and this prevents removal of the picket from either rail and securely fastens the picket into a panel.

Figure 6E:
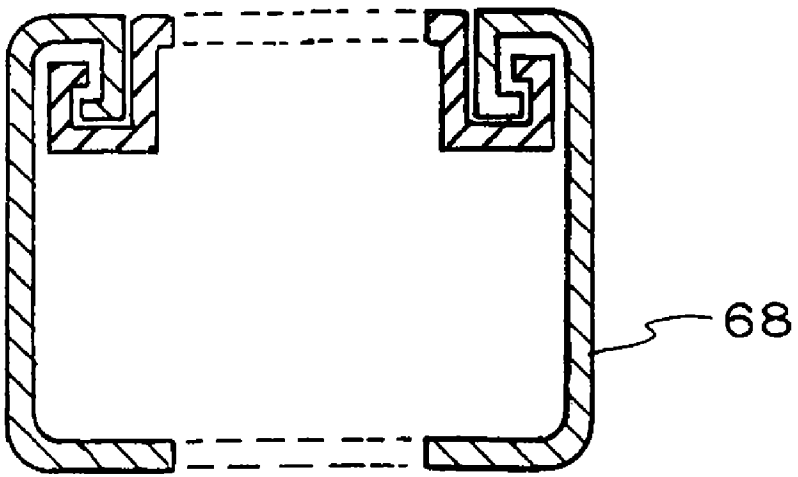
Figure 7D:
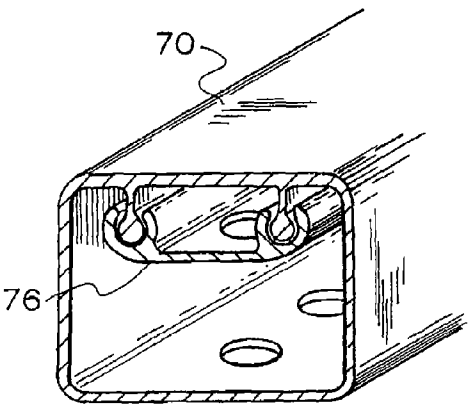
Figure 7C:
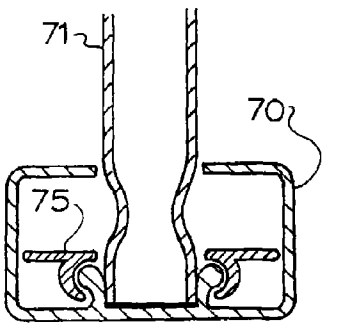
Figure 7B:
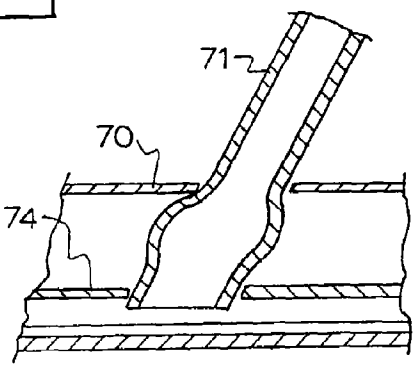
Figure 7A:
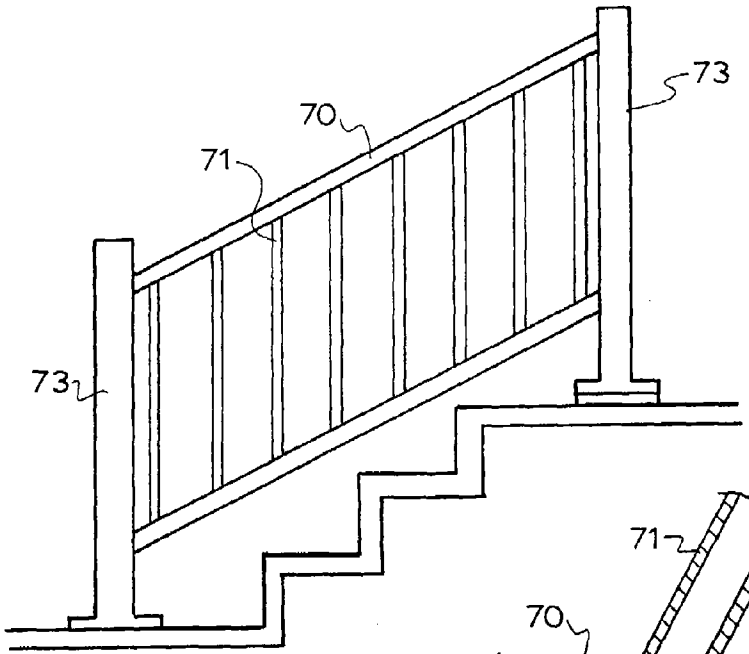

FIG. 6 shows an enhancement of FIG. 5. In this example, top rail 60 now includes a support structure 61 which engages one end of the picket 62 to strengthen the panel once assembled. A portion of the picket has been crimped between within rail and below the support structure. Bottom rail 63 functions as before. In FIG. 6*b* the support structure is indicated as a plate 65 with a series of apertures. In FIG. 6*c* the support structure is a hollow section with a series of apertures or a continuous flange 66 within the rail. In FIG. 6*d* the plate 65 in FIG. 6*b* is held by fixtures 67 on the in side walls of the rail. In FIG. 6*e*, the support structure is adapted for a bottom rail or mid rail 68 and allows the pickets to pass through the rail. It will be appreciated that a wide range of internal structures are possible for the same or similar effect.

FIG. 7 shows how the enhancement may assist with a raked panel such as required in a bannister. In FIG. 7*a* the rails 70 are not perpendicular to the pickets 71, and the pickets pass only partially through both the top and bottom rails. Posts 73 are generally parallel to the pickets. As shown in FIG. 7*b* this may require a support structure 74 similar to that in FIG. 6*a*, but enabling the apertures for the pickets to be offset within the rail. The structure may be slidable within the rail to assist assembly and installation of the panel on site. FIGS. 7*c* and 7*d* show how a slidable plate 75 or flange 76 may be formed within the rail. Note that the apertures in the support structure may be elongated in the case of circular pickets to accommodate the angular deviation.

FIG. 8 schematically shows equipment for crimping a series of pickets inside a set of rails to form a panel. In FIG. 8*a* the equipment includes a frame having a first portion 80 for holding a pair of rails to form a panel and a second portion 81 for holding a crimping device that passes through the rails. The rails lie in brackets 82 on frame portion 80 while the crimping device has two separate tools 83 that are aligned with the brackets 82. Each tool is fixed at one end to a moveable carrier 84 by a bracket 85 and passes through a second bracket 86 at the other end for alignment with a respective rail, shown in further detail in FIG. 8*b*. In this example, bracket 86 includes two plates 87 and a series of pins 88 which define a path for the tools 83.

In FIG. 8*a*, a pair of chains 90 drive the carrier 84 back and forth in the frame portion 81 which in turn drives the tools 83 of the crimping device back and forth through the brackets 86. The chains rotate in a two-part cycle around axles 91 driven by a motor 92. Leaf springs 93 mounted on frame 81 provide tension in the chain and accommodate variations in the motion caused by the action of tools 83 when crimping pickets in a panel. It will be appreciated that different panel structures will require different arrangements of the brackets 82 and that in general a wide variety of equipment is conceivable as alternatives to the frame structure and components shown here.

FIGS. 8*b* to 8*g* show the equipment of FIG. 8*a* in action to produce a simple panel. In FIG. 8*c* a pair of rails 95 have been placed in brackets 82, in alignment with the tools 83 of the crimping device. The carrier is at the start of a cycle. In FIG.

8*d* the carrier 84 has moved from right to left in frame 81 pushing the tools 83 into their respective rails and has reached half way in the cycle. In FIG. 8*e* a series of pickets 96 have been inserted through the rails with the rods 83 held stationary. In FIG. 8*f* the carrier has moved back through the frame 81 pulling the tools through the rails and crimping the pickets inside the rails, to complete the cycle. The complete panel is removed in FIG. 8*g*.

FIG. 9 schematically shows action of a crimping tool in FIG. 8. In FIG. 9*a*, a tool 100 is positioned then pulled through a rail 101 containing series of pickets 102, seen from above in cross section. In this example the tool includes two parallel elongate rods or bars, having opposed and thickened end portions 103. The end portions of the bars remain together and sequentially compress the portions of the pickets within the rail. In this case the tool is passed into the rail before insertion of the pickets. FIG. 9*b* shows alternative crimping tools, including bars having rounded wedge portions 105, stepped wedge portions 106, and a roller assisted wedge portion 107.

FIG. 10 shows a further alternative crimping tool intended for rapid processing of an assembled panel in which the pickets are already located in the rails. In FIG. 10*a* the tool includes a bar 110 with a wedge 111 mounted on an arm 112. A slider 113 is also mounted on the arm 112 and is able to move back and forth in relation to the wedge. The arm passes through an aperture 114 in the slider. An inclined surface 115 assists the slider to move onto the wedge. The slider and the wedge are formed from a relatively rigid or dense material such as hardened steel.

In FIG. 10*b* the slider 113 is aligned with the bar 110 as the tool is inserted in a rail 118 containing pickets 119. The slider is within the width of the bar and passes the pickets without crimping. As the tool is withdrawn the slider relocates onto the wedge and is deflected out of alignment with the bar. The slider effectively extends beyond the width of the bar thereby contacting and deforming the pickets within the rail as the bar is withdrawn. It will be appreciated that a variety of different tools having an action of this general kind can be designed.

FIG. 11 shows further equipment as an alternative to the equipment in FIG. 8, and could be used with the crimping tools of either FIG. 9 or 10. The equipment includes a frame having a first portion 110 for holding one or more rails to form a panel and a second portion 111 for holding a crimping tool that passes through the rails. In this example, two rails would be placed in brackets 112 on frame portion 110, aligned with two rods 113 that pass through brackets 114, similar to FIG. 8*b*. Each rod is fixed at one end to a moveable carrier 115 which is driven back and forth between the frame portions by a ram 116, and held in place on portion 111 by sleeves 118. The ram is in turn driven by a motor or pump 117 under automatic or manual control.

The invention claimed is:

1. A panel for a fence comprising:

at least one hollow rail having pairs of first and second apertures extending through upper and lower walls, respectively; and a plurality of pickets supported by the rail, each picket passing through a first and second aperture pair, thereby passing through the rail and ending outside of the rail, the first aperture being spaced from the second aperture, a portion of each picket located inside of the rail between the first and second apertures being compressed partially radially inwardly within the rail in first and second converging directions thereby expanding the portion of each picket located inside of the rail partially radially outwardly within the rail in third and fourth diverging directions to thereby prevent further passage of each picket through the first and second apertures.

2. The panel for a fence according to claim 1, wherein the portion of each picket that has been deformed within the rail has a partly flattened shape that no longer fits through the first and second apertures in the rail.

3. The panel according to claim 1, further comprising a pair of rails which support the pickets.

4. The panel according to claim 1, wherein the portion of each picket located inside of the rail is flattened in the first and second converging directions to form two generally opposed planar parallel walls that are both generally parallel with a longitudinal axis of one of the plurality of pickets.

5. The panel according to claim 1, wherein the rail is a tubular structure that has a unitary and continuous outer wall that extends around the periphery of the hollow rail.

6. The panel according to claim 1, wherein the first and second diverging directions are perpendicular to a longitudinal axis of one of the plurality of pickets.

7. A panel for a fence comprising:

at least one hollow rail;

a plurality of pickets supported by the rail, the rail having an external wall with entry apertures extending through the external wall for receiving the pickets; and an internal wall, spaced internally from the external wall and the entry apertures and having a plurality of holding apertures, wherein each picket enters the rail through a respective entry aperture and an end portion of each picket passes through and is received by a corresponding holding aperture in the internal wall, a portion of each picket located inside of the rail between the entry and holding apertures being compressed partially radially inwardly within the rail in first and second converging directions thereby expanding the portion of each picket located inside of the rail partially radially outwardly within the rail in third and fourth diverging directions such that portion of the picket is held between the respective entry aperture and the corresponding holding aperture.

8. The panel according to claim 7, wherein the holding apertures are aligned with the entry apertures so that the pickets are perpendicular to the rail.

9. The panel according to claim 7, wherein the holding apertures are offset from the entry apertures so that the pickets are not perpendicular to the rail.

10. The panel according to claim 7, wherein the internal wall is moveable within the rail to vary the alignment of the holding apertures and the entry apertures, prior to insertion of the pickets through the entry and exit apertures and the apertures in the internal wall.

11. The panel according to claim 7, wherein the holding apertures are formed by a plurality of flanges which receive and hold portions of respective pickets.

* * * * *